US006634428B2

(12) United States Patent
Krauss et al.

(10) Patent No.: US 6,634,428 B2
(45) Date of Patent: Oct. 21, 2003

(54) DELAYED OPENING BALL SEAT

(75) Inventors: Christiaan D. Krauss, Houston, TX (US); George Givens, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 9 days.

(21) Appl. No.: 09/848,532

(22) Filed: May 3, 2001

(65) Prior Publication Data

US 2002/0162661 A1 Nov. 7, 2002

(51) Int. Cl.[7] ..... E21B 34/14
(52) U.S. Cl. ..... 166/317; 166/318; 166/332.4
(58) Field of Search ..... 166/317, 318, 166/332.4, 334.1, 334.4

(56) References Cited

U.S. PATENT DOCUMENTS

| | | | | |
|---|---|---|---|---|
| 3,090,442 A | | 5/1963 | Cochran et al. | |
| 3,220,481 A | | 11/1965 | Park | |
| 3,220,491 A | | 11/1965 | Mohr | |
| 3,776,258 A | * | 12/1973 | Dockins, Jr. | 137/269 |
| 4,114,694 A | | 9/1978 | Dinning | |
| 4,292,988 A | | 10/1981 | Montgomery | |
| 4,510,994 A | | 4/1985 | Pringle | |
| 4,520,870 A | | 6/1985 | Pringle | |
| 4,729,432 A | | 3/1988 | Helms | |
| 4,823,882 A | | 4/1989 | Stokley et al. | |
| 4,828,037 A | | 5/1989 | Lindsey et al. | |
| 4,862,966 A | * | 9/1989 | Lindsey et al. | 166/382 |
| 4,893,678 A | | 1/1990 | Stokley et al. | |
| 4,915,172 A | * | 4/1990 | Donovan et al. | 166/278 |
| 5,146,992 A | | 9/1992 | Baugh | |
| 5,244,044 A | | 9/1993 | Henderson | |
| 5,413,180 A | | 5/1995 | Ross et al. | |
| 5,960,881 A | | 10/1999 | Allamon et al. | |
| 6,053,248 A | * | 4/2000 | Ross | 166/297 |
| 6,053,250 A | * | 4/2000 | Echols | 166/317 |
| 6,079,496 A | | 6/2000 | Hirth | |
| 6,155,350 A | | 12/2000 | Melenyzer | |

* cited by examiner

*Primary Examiner*—William Neuder
(74) *Attorney, Agent, or Firm*—Steve Rosenblatt

(57) ABSTRACT

A removable ball seat assembly is disclosed. It features a solid ball seat backed up by segmented dogs pinned to each other and mounted under the ball seat. Upon actuating a downhole tool with fluid pressure applied to a ball on the seat, the pressure is increased and the ball and seat move at a regulated rate. The dogs reach a recess and the ball moves through the seat. Subsequent, larger balls can pass through the seat, with the dogs in the recess, at much smaller pressure drops than the original ball.

20 Claims, 2 Drawing Sheets

DELAYED OPENING BALL SEAT

FIELD OF THE INVENTION

The field of this invention relates to pump through ball seats used to build downhole pressure to actuate tools and more particularly to ball seats for use with liner hangers which must accommodate subsequent passage of wiper plugs during liner cementing or a larger ball for further downhole operations.

BACKGROUND OF THE INVENTION

Downhole operations frequently involve the need to build up pressure to set a tool and/or to release from a tool. After the setting and release occurs, there is a need for access downhole. In the past ball seats have been used in combination with a ball or balls dropped from the surface to provide a way to close a tubular temporarily to allow for the requisite pressure buildup. The ball seats have to serve conflicting functions. They must be sturdy enough to withstand large differential pressures for a sufficient time to set the tool. They must cleanly release the ball to allow for subsequent objects such as wiper plugs or another, bigger, ball to pass through the spent ball seat with minimal pressure drop. They must be relatively easy to mill out of the way to accommodate subsequent downhole operations.

Yet another problem is the potential to over pressure the formation below as the requisite pressure on the ball has been built up and needs to be released. In the past, this problem has been addressed by using a reduced shock mechanism as part of the ball seat design. As shown in U.S. Pat. No. 6,079,496, the ball seat is movably mounted with the landing collar and pressure buildup on the ball moves the ball seat to reduce the volume of a variable volume cavity whose outlet is restricted. The restrictor, in turn, regulates the flow out of the cavity, which forces the ball seat to move at a predetermined rate, to reduce shock on the formation below. This Patent also teaches the use of non-metallic materials to facilitate milling out of the landing collar. Millout must occur because the ball seat assembly is designed to remain downhole with the liner being set and cemented.

Other prior designs have focused on construction of the ball seat. Some designs used segmented collets which shifted longitudinally under pressure with a ball on the seat formed by the segmented collets until a recess was reached allowing the segmented collets to spread and the ball to pass. Some examples of the segmented collet design are U.S. Pat. Nos. 5,244,044; 4,893,678; 4,823,882; 4,292,988; 3,220,481. Of these, U.S. Pat. No. 4,292,988 is most notable because it also has a provision to regulate the movement of the ball seat after its securing shear pin is broken to reduce shock. Another design involved a solid ball seat which expanded when moved to an unsupported position to let the ball pass. Some examples of this design are U.S. Pat. Nos. 4,520,870; 4,510,994; 4,114,694; 3,090,442; 4,862,966 and 6,155,350 (which also incorporates a controlled release pressure feature). Still other designs contemplated plastic deformation of the seat or controlled breakage along scoring of the seat to allow the ball or balls to be pumped through. Examples of this variation are U.S. Pat. Nos. 5,146,992 and 5,960,881.

Some of the drawbacks of the prior designs are addressed as the objectives of the present invention. The ball seat assembly is removable with the setting tool and running string so that it does not need to be milled out subsequently.

The ball seat is firmly supported by segmented dogs held together with roll pins and disposed on the back side of the solid frusto-conically shaped ball seat. The problem of erosion of the ball due to rapidly moving fluid that could leak past segmented collets forming the ball seat is eliminated with the new ball seat design.

Another drawback of prior designs which used solid ball seats, such as U.S. Pat. Nos. 5,146,992 and 5,960,881 is eliminated by the present invention. In the past after an initial ball was pushed through the seat, subsequent balls would require high pressures to clear through the ball seat because of the point of contact made with the ball seat by the bigger ball. This was undesirable as it was advantageous to get the next and larger ball through the seat at low pressure differentials to expedite the next downhole operation and to avoid setting off relief devices built into such subsequent balls. These and other advantages of the present invention will become more apparent to those skilled in the art from a review of the description of the preferred embodiment, described below.

SUMMARY OF THE INVENTION

A removable ball seat assembly is disclosed. It features a solid ball seat backed up by segmented dogs pinned to each other and mounted under the ball seat. Upon actuating a downhole tool with fluid pressure applied to a ball on the seat, the pressure is increased and the ball and seat move at a regulated rate. The dogs reach a recess and the ball moves through the seat. Subsequent, larger balls can pass through the seat, with the dogs in the recess, at much smaller pressure drops than the original ball.

DETAILED DESCRIPTION OF THE PREFERRED EMBODIMENT

Figure 1:
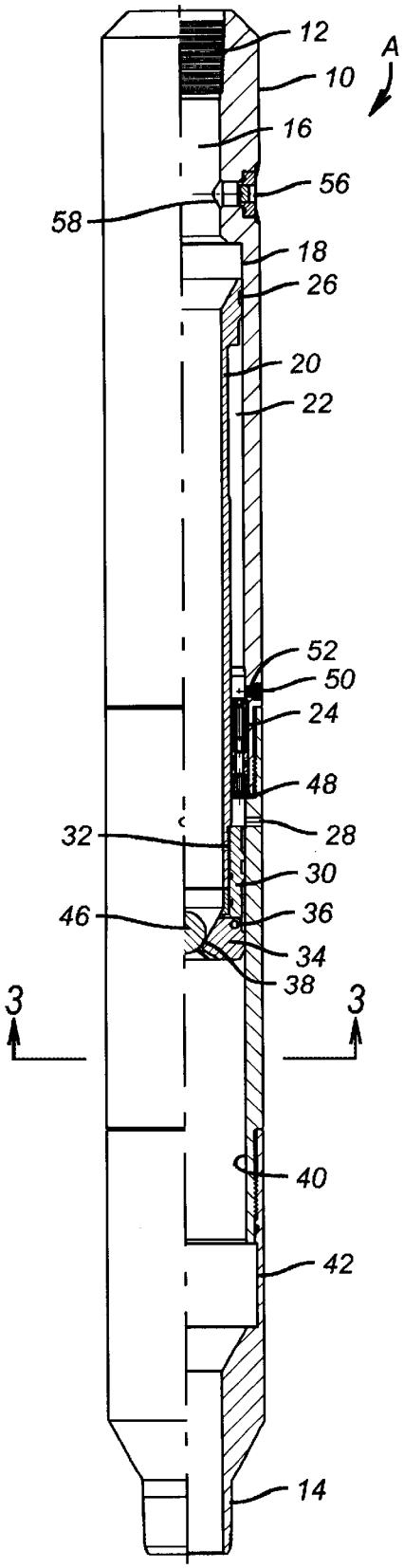
FIG. 1 is a sectional view, in elevation of the invention, in the run in position.

Referring to FIG. 1, the apparatus A has a body 10 and a thread 12 adjacent the upper end. A thread 14 is disposed at the lower end of body 10. In one application, a liner hanger setting and release tool (not shown) can be secured to thread 12 and another ball seat assembly can be secured to thread 14 to allow setting an external casing packer, for example. It is understood that body 10 is ultimately supported by "tubulars" from the well surface (not shown) and that at some point, body 10 is retrieved from the wellbore with such tubulars. "Tubulars" is defined as comprising coiled tubing or rigid pipe.

Body 10 has a passage 16 that runs though it. Passage 16 has a recessed segment 18 in which sits sleeve 20. Sleeve 20 defines an annular passage 22 in which restriction orifice 24 is disposed. Seal 26 is mounted on sleeve 20 to seal off the top of annular passage 22 as the sleeve 22 moves down. The restriction orifice 24 is secured to body 10, such that downward movement of the sleeve 20 reduces the volume of annular passage 22 by squeezing fluid through restriction orifice 24 at a regulated rate. Appropriate seals between the sleeve 20 and the restriction orifice 24 allows for pressure buildup against restriction orifice 24 by reason of downward movement of sleeve 20. Fluid displace through restriction orifice 24 exits body 10 through opening 28.

Figure 2:
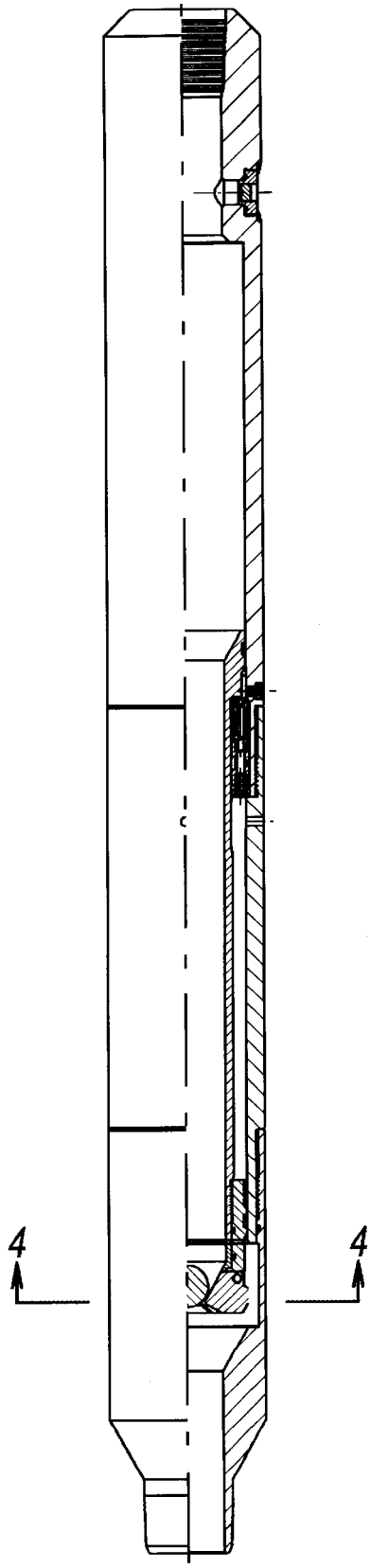
FIG. 2 is the view of FIG. 1 in the position just before the ball is blown through the seat.
Figure 5:
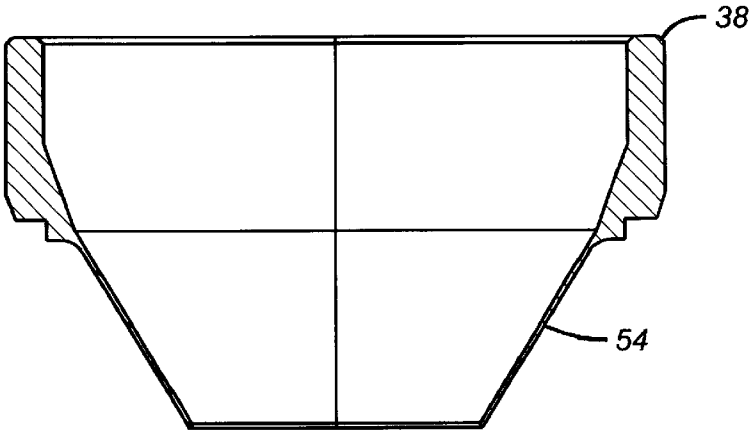
FIG. 5 is a section view, in elevation, of the ball seat.
Figure 6:
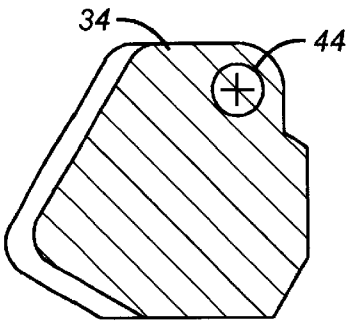
FIG. 6 is a section view, in elevation, of one of the dog segments.
Figure 3:
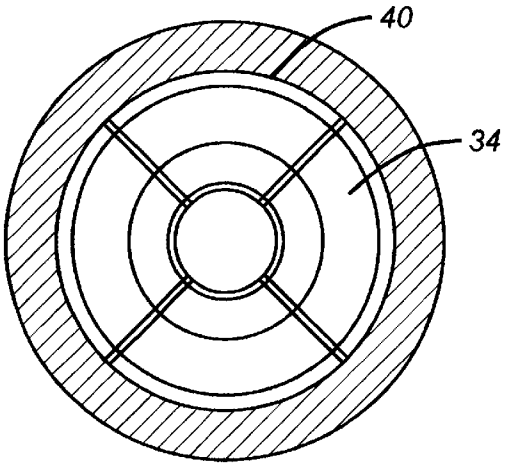
FIG. 3 is the view along lines 3—3 of FIG. 1.
Figure 4:
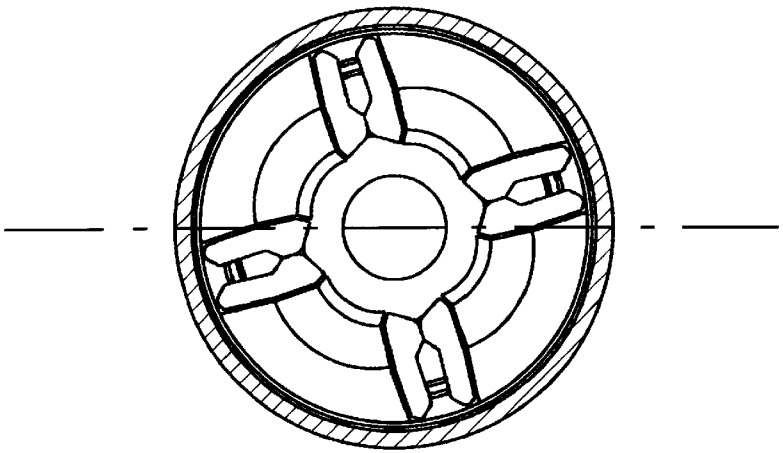
FIG. 4 is the view along lines 4—4 of FIG. 2.

Retainer 30 is secured at thread 32 to sleeve 20. Segmented support dogs 34 are doweled to retainer 30 using dowels or roll pins 36. A ball seat 38 is supported by sleeve 20 using retainer 30. The preferred material for ball seat 38 is 6061-T6 aluminum. Dogs 34, in the run in position of FIG. 1, are also supported by the inner wall 40 of recessed segment 18. A groove 42 is disposed at the lower end of wall 40 to allow the dogs 34 to become unsupported, when moved to the position shown in FIG. 2. FIG. 3 shows the dogs 34 fully supported by wall 40 during run in. FIG. 4 shows the dogs 34 separated after becoming aligned with groove 42. FIG. 5 illustrates the ball seat 38 which is disposed at the lower end of sleeve 20. FIG. 6 illustrates a dog 34 and the opening 44 for the dowel or roll pin 36. Landing a ball 46 on the ball seat 38 initiates the process, which will be described below.

The apparatus A is lowered downhole on tubing or a tubular string. Located above body 10 is a liner hanger. Located below body 10 may be receptacles for catching plugs for subsequent completion operations such as displacement of fluids or cement or setting an external casing packer (not shown). A ball 46 is dropped from the surface and lands on ball seat 38. The pressure is built up to set, for example, the liner hanger (not shown), to a level in the order of 2000 pounds per square inch (PSI) surface pressure, which is equivalent to about 5,000 PSI in annular passage 22, depending on dimensions. After the hanger is set, the surface pressure is increased further to about 2,500 PSI until rupture disc 48 located below restriction orifice breaks at a pressure closer to about 6300 PSI, in annular chamber 22. The movement of sleeve 20 varies with the size of restriction orifice 24 and can be set to take several minutes, before dogs 34 reach groove 42. Fluid is displaced out of opening 28. If the restriction orifice 24 fails to function, a backup rupture disc 50 will break at about 4200 PSI applied from the surface or roughly 10,600 PSI in annular chamber 22. If rupture disc 50 operates then restriction orifice 24 is bypassed and there is not shock reduction effect on the formation. This is because there is no longer a restriction limiting the exit rate of fluid from annular passage 22, as the fluid now escapes abruptly through opening 52.

In normal operation, the breakage of rupture disc 48 allows sleeve 20 to move at a regulated rate until the dogs 34 come into alignment with groove 42. The dogs then pivot about dowels 36 removing support for the tapered segment of the ball seat 38. The ball seat 38 can then be expanded or extruded by ball 46 as ball 46 is blown through the ball seat 38 after landing on it, as shown in FIG. 2. The subsequent well operations may require wipers or plugs that exceed the diameter of ball 46 to pass through ball seat 38. Because ball seat 38 has been deformed by the passage of ball 46 and is no longer supported by dogs 34, very low differential pressure in the order of less than 500 PSI is required to force such subsequent plugs or past the former tapered segment 54, see FIG. 5. These subsequent wipers, balls or plugs have built into them rupture discs, in the event they fail to travel all the way to their intended receptacle. Accordingly, because ball seat 38 is no longer supported by dogs 34 and further because it has been expanded by ball 46, there is little danger of blowing rupture discs on subsequent plugs or balls as they try to pass through ball seat 38. Ball seat 38 is preferably made of a solid piece without gaps as in the prior designs which used a collection of collets to form a ball seat. Rather, ball seat 38 is more akin to the ball seat in U.S. Pat. No. 5,146,992 insofar as it is a solid piece. However the function of ball seat 38 is different than the ball seat of U.S. Pat. No. 5,146,992 as described herein.

If, for any reason the ball 46 will not go through the ball seat 38, rupture disc 56 will blow at about 5000 PSI surface pressure and will provide a flowpath for subsequent operations through opening 58 in body 10. It should be noted that rupture disc 56 is not in annular passage 22 and is therefor exposed directly to surface pressure at all times. In this manner the obstructed sleeve 20 can be bypassed for subsequent operations such a cementing the liner.

The advantages of the apparatus A over the prior designs will now be readily apparent. The components such as the ball seat 38 can be made of metallic components since subsequent milling is not an issue in view of the fact that body 10 is removed when the requisite completion operations are accomplished. Using high strength components for the ball seat 38 and backing it with dogs 34 for additional support, allows high setting pressures for a sustained period to be applied to ball 46 for setting the liner hanger (not shown), for example. The ball seat can have a relatively thin tapered If) segment 58 which is about 0.020 inches plus or minus 0.002 with an initial outlet opening of about 1.28 inches and a slope of 30 degrees as measured from the longitudinal axis. With backing from dogs 34 it will readily hold the 2,500 PSI pressure from the surface necessary to break rupture disc 48 so sleeve 20 can move down. On the other hand, once the support from dogs 34 is removed, the ball 46 easily pushes through the tapered segment 54. Furthermore, subsequent larger balls or plugs engage the now expanded and unsupported tapered segment 54 higher up than ball 46 or at the same height on the now expanded opening and therefore pass easily without large pressure differentials. Surface pressures of 500 PSI or less will allow such subsequent balls or plugs to pass uneventfully. On top of all these advantages, there is the reduced shock feature on the formation from the action of restrictor 24 after rupture disc 48 is broken.

In the prior designs, downhole environments affected performance of the ball seats. Phenomena such as water hammer and fluid decompression at the time of ball landing due to well losses was loading these ball seats and causing a low shear, without surface pressure being applied. Because of this phenomenon, hydraulic hangers would not set and hydraulic running tools might not release. Another consequence was that subsequent cement jobs were performed without wiper plugs due to concerns over whether downhole equipment would function properly. The present invention addresses these concerns and overcomes these and other shortcomings of the prior art as described above.

While the invention has been described and illustrated in detail in the drawings and foregoing description, the same is to be considered as illustrative and not restrictive in character, it being understood that only the preferred embodiment has been shown and described and that all changes and modifications that come within the scope of the claims below are the full scope of the invention being protected.

We claim:

1. A seat assembly run in on tubulars to receive an obstructing object to operate a downhole tool, comprising:

a body, having a bore therethrough, securable to the downhole tool, an enlargeable non-segmented seat mounted in said body; and a support to selectively reinforce said seat, without pre-compression of said seat, for acceptance of an obstructing object, said support, when disabled allowing the obstructing object to enlarge said seat as it passes through.

2. The assembly of claim 1, further comprising:

said seat moveable between a first and second position, said support becoming disabled as a result of movement of said seat to said second position.

3. The assembly of claim 1, wherein:

said seat with said body is removable from the wellbore with the tubulars.

4. The assembly of claim 1, wherein:

said seat comprises a tapered lower end;

said tapered lower end of said seat can retain the obstructing object in said first position against substantially higher differential pressures than required to pass another object of a larger dimension than the obstructing member through said seat in its second position and after the obstructing member has extruded and moved through said seat, even if the second object further enlarges said seat.

5. The assembly of claim 4, further comprising:

a movable mounting of said seat between a first and second position, said support becoming disabled as a result of movement of said seat toward said second position.

6. A seat assembly run in on tubulars to receive an obstructing object to operate a downhole tool, comprising:

a body, having a bore therethrough, securable to the downhole tool, an enlargeable solid seat mounted in said body; and a support to selectively reinforce said seat for acceptance of an obstructing object, said support, when disabled allowing the obstructing object to enlarge said seat as it passes through;

said seat moveable between a first and second position, said support becoming disabled as a result of movement of said seat to said second position;

a speed restrictor to regulate the rate of movement of said seat between said first and said second positions.

7. The assembly of claim 6, further comprising:

a speed restrictor bypass operable responsively to fluid pressure in said body to allow unregulated movement of said seat in the event said speed restrictor malfunctions in a manner which would otherwise impede movement of said seat.

8. The assembly of claim 7, further comprising:

a body bypass operable responsively to a higher fluid pressure in said body than required to open said speed restrictor bypass, said body bypass operable responsive to pressure buildup with said seat in said second position with an obstructing object that refuses to pass through.

9. A seat assembly run in on tubulars to receive an obstructing object to operate a downhole tool, comprising:

a body, having a bore therethrough, securable to the downhole tool, an enlargeable solid seat mounted in said body; and a support to selectively reinforce said seat, without pre-compression of said seat, for acceptance of an obstructing object, said support, when disabled allowing the obstructing object to enlarge said seat as it passes through;

said seat moveable between a first and second position, said support becoming disabled as a result of movement of said seat to said second position;

said seat is secured to a sliding sleeve mounted in said bore; and said support is mounted to said sleeve for tandem movement with said seat.

10. The assembly of claim 9, wherein:

said support is pivotally mounted to said sleeve.

11. The assembly of claim 10, wherein:

said body further comprises a recess in said bore adjacent said second position of said seat, said support becoming disabled by pivoting into said recess and away from said seat.

12. The assembly of claim 11, wherein:

said support comprises a plurality of dogs pinned to said sliding sleeve;

said seat having a tapered lower end and said dogs having a conforming face to said taper and in contact therewith when said seat is in said first position.

13. The assembly of claim 12, wherein:

said dogs having an outer face disposed such that in said first position of said seat said dogs are supported by said bore against said tapered lower end until movement of said sleeve aligns said outer face with said recess in said bore at said second position of said seat.

14. A seat assembly run in on tubulars to receive an obstructing object to operate a downhole tool, comprising:

a body, having a bore therethrough, securable to the downhole tool, an enlargeable solid seat mounted in said body; and a support to selectively reinforce said seat for acceptance of an obstructing object, said support, when disabled allowing the obstructing object to enlarge said seat as it passes through;

said seat moveable between a first and second position, said support becoming disabled as a result of movement of said seat to said second position:

said seat is secured to a sliding sleeve mounted in said bore;

said support is mounted to said sleeve for tandem movement with said seat;

said sleeve defines a sealed annular passage in said bore of said body;

said body further comprises a speed restrictor mounted to said body in said annular passage to regulate the rate of movement of said seat between said first and said second positions as a result of fluid forced therethrough when movement of said sleeve reduces the volume of said annular passage.

15. The assembly of claim 14, wherein:

said flow restrictor is initially obstructed by a first removable member responsive to applied pressure on an obstructing member on said seat applying fluid pressure through said sleeve on fluid in said annular passage, said seat moving at a regulated rate as fluid is displaced from said annular passage only after said removable member is disabled.

16. The assembly of claim 15, wherein:

a second removable member in an opening in said body in communication with said annular passage and on the opposite side of said restrictor from said first removable member, wherupon failure of said first removable member to become disabled, said second removable member becomes disabled at a higher applied pressure than required to normally disable said first removable member, which results in unregulated movement of said seat between said first and said second positions.

17. A seat assembly run in on tubulars to receive an obstructing object to operate a downhole tool, comprising:

a body, having a bore therethrough, securable to the downhole tool, an enlargeable solid seat mounted in said body; and a support to selectively reinforce said seat, without pre-compression of said seat, for acceptance of an obstructing object, said support, when disabled allowing the obstructing object to enlarge said seat as it passes through;

said seat comprises a tapered lower end;

said tapered lower end of said seat can retain the obstructed object in said first position against substantially higher differential pressures than required to pass another object of a larger dimension than the obstructing member through said seat in its second position and after the obstructing member has extruded and moved through said seat, even if the second object further enlarges said seat;

a movable mounting of said seat between a first and second position, said support becoming disabled as a result of movement of said seat toward said second position;

a speed restrictor to regulate the rate of movement of said seat between said first and said second positions.

18. The assembly of claim 17, wherein:

said seat with said body is removable from the wellbore with the tubulars.

19. The assembly of claim 18, wherein:

said seat is secured to a sliding sleeve mounted in said bore; and said support is mounted to said sleeve for tandem movement with said seat.

20. The assembly of claim 19, wherein:

said body further comprises a recess in said bore adjacent said second position of said seat, said support becoming disabled by pivoting into said recess and away from said seat.

* * * * *